US005558246A

United States Patent [19]

Ross, Jr.

[11] Patent Number: 5,558,246

[45] Date of Patent: Sep. 24, 1996

[54] BOTTLED GAS TANK HOLDER

[76] Inventor: George S. Ross, Jr., 12 Mirra Ave., Derry, N.H. 03038

[21] Appl. No.: 489,588

[22] Filed: Jun. 12, 1995

[51] Int. Cl.[6] ..... B65D 25/20

[52] U.S. Cl. ..... 220/737; 220/4.22; 220/7; 220/401

[58] Field of Search ..... 220/6, 7, 4.28, 220/4.29, 4.24, 4.22, 4.21, 4.08, 9.3, 9.2, 400, 401, 485, 666, 668, 724, 725, 737, 743

[56] References Cited

U.S. PATENT DOCUMENTS

| | | | |
|---|---|---|---|
| 1,091,008 | 3/1914 | Nagle | 220/401 |
| 1,643,407 | 9/1927 | Florance | 220/401 |
| 1,779,060 | 10/1930 | Choate | 220/401 |
| 1,885,788 | 11/1932 | Westburg | 220/743 |
| 4,026,435 | 5/1977 | Hendon | 220/743 |
| 4,457,445 | 7/1984 | Hanks et al. | 220/724 |
| 4,694,972 | 9/1987 | Bimonte et al. | 220/401 |
| 4,901,959 | 2/1990 | Stage | 220/401 |

FOREIGN PATENT DOCUMENTS

| | | | |
|---|---|---|---|
| 724881 | 2/1955 | United Kingdom | 220/485 |

*Primary Examiner*—Stephen J. Castellano
*Attorney, Agent, or Firm*—George W. Dishong

[57] ABSTRACT

A rack device or tank holder for the secure and safe holding of tanks of compressed gas such as carbon dioxide typically used by restaurants, bars, hospitals, and fast food places for the carbonation of soft drinks. The holder is sturdy and light weight. The holder is compatible with existing tanks and holding mechanisms and is intended to comply with all known federal rules governing the transportation of compressed gases such as carbon dioxide. The holder is comprised of at least two horizontal rings held together by at least three vertical legs. The rack device or holder may also features a hinged door to allow for front loading of the compressed gas tank when top loading is neither practical nor feasible. A latch on the hinged door holds the tank securely until time for it to be removed. The rack device may also have a mechanism such as a block which locates the tank when it is placed within the tank holder.

1 Claim, 1 Drawing Sheet

BOTTLED GAS TANK HOLDER

BACKGROUND OF THE INVENTION

1. Field of the Invention

This invention most generally relates to a rack device or holder for holding bottles or cylinders containing compressed gas for vehicle transportation according to the Federal Motor Carriers Safety Regulations. Even more particularly the invention relates to a device to hold the compressed gas carbon dioxide containers such as those used for carbonating soft drinks. Alternatively, the holder device could be used in the storage of tanks and where ever carbon dioxide tanks are used.

2. Description of the Prior Art

Presently there is nothing available that permits the safe and effective storage or shipment of compressed gas carbon dioxide tanks. There has been little inventive activity in the field of containers, devices or methods for holding such tanks firmly and safely. Generally, the tanks are shoved onto or into trucks now and held with rope to restrain them from moving around. In use in bars, hospitals, restaurants, and fast food places where soft drinks are served, the tanks are set on the floor where ever there is room and kicked around if the tank extends into the working aisle. Currently, Federal Motor Carrier Safety Regulations require special handling of compressed gas cylinders.

It would be desirable and advantageous to have a gas tank holder that is both strong and light weight for carbon dioxide tanks. It would also be desirable and advantageous if the holders were compatible with existing tanks and holding mechanisms. It would also be desirable to have a hinged opening to allow insertion of a tank from the front without having to lift the tank. Lifting one tank may not be that much of a problem. Lifting such tanks for an eight hour shift can be extremely tiring. Such a hinged opening would allow a gas tank to be slid into place and secured. It would be an additional advantage if the tank holder were of sturdy construction such that replacement would be an infrequent occurrence.

A further desirable attribute of the invention would be to meet all of the federal rules governing transportation of such containers of compressed gas.

SUMMARY OF THE INVENTION

Basically the present invention in its most simple form or embodiment is directed to a special holder for carbon dioxide tanks whether the tanks are being transported or in use at the end site. The special container securely and safely positions and holds the carbon dioxide tank within it. The tank holder is comprised of two or more rings which are the same diameter with the center of the circles being on the same line. That line is the center line of the tank holder and the tank when the tank is present. The rings are held together by at least three legs attached to the top ring and extending past the lowermost ring to the floor. The dimensions are such that the tank is held securely yet open at the top allowing hoses to be attached to the tank nozzle. The legs can end with a flare at the bottom to allow the holder to be bolted to the floor for more security. Special shape holes can be placed in the feet to allow slip lock insertion of the bolt heads to secure the feet.

There are times when a tank cannot be lifted into such a holder. If a panel truck has limited space, there may not be enough free space above the tank holder to allow the tank to be picked up the height of the tank and inserted into the holder. Behind a bar or soda fountain, space is at a premium. Therefore, an additional embodiment features a hinge on the rings so that the holder can be opened allowing the carbon dioxide tank to be placed into the holder from the front. A latch secures the tank in the holder after the holder is closed.

The holder must be sturdy because of the use it must endure. When a worker is loading a truck, he or she does not have time to be careful the tank does not hit the holder too hard. Often when a bar or fountain worker has to change tanks, it is at the busiest time of the work shift. The old empty tank is pulled out and the new tank is thrown in and connected as soon as possible. The orders are backing up and changing tanks is a non-productive task. Therefore, the holder must be made of stainless steel or a heavy duty durable plastic. The plastic might be more appealable to a truck where the weight may already be a factor and the amount of gasoline used depends on the weight.

Clearly, the tank holder may have a variety of configurations and may be made from a variety of materials. For example, the number of legs may be three or more. More rings may be added to increase the rigidity of the holder. Although stainless steel is used in the preferred embodiment, other materials such as a sturdy, durable plastic may be used.

A primary object of the invention is to provide a safe and secure holder for carbon dioxide tanks during both shipment and during use that is both strong and light weight. It is another primary object of the present invention to provide a holder that is compatible with existing tanks and tank holding mechanisms. It is a further primary object of the present invention to provide the holder with a hinge assembly to provide frontal access to the holder. It is a still further primary object of the present invention to comply with all federal rules governing the transportation of compressed gas tanks.

These and further objects of the present invention will become apparent to those skilled in the art after a study of the present disclosure of the invention and with reference to the accompanying drawings which are a part hereof, wherein like numerals refer to like parts throughout, and in which:

DESCRIPTION OF THE PREFERRED EMBODIMENTS

The following is a description of the preferred embodiment of the invention. It is clear that there may be variations in the size and the shape of the apparatus. However, the main features of the device are a sturdy, light weight carbon dioxide tank holder that is compatible with existing tanks and meets the rules governing transportation of such compressed gas tanks. Other embodiments allow insertion of the tank from the front as opposed to insertion from the top.

Figure 1:
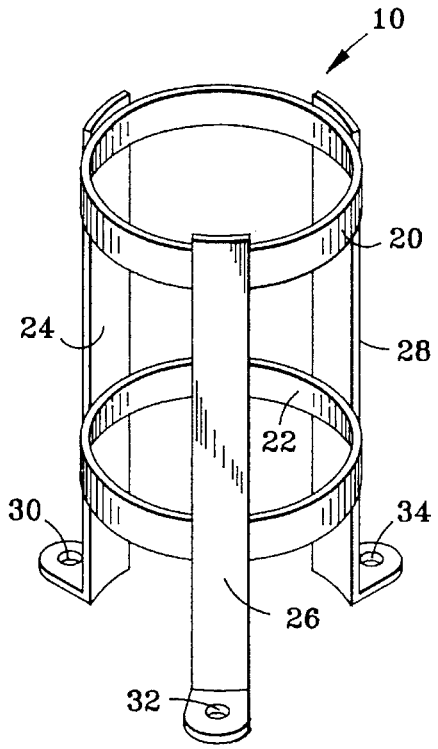
FIG. 1 is a perspective illustration of the carbon dioxide tank holder.
Figure 2:
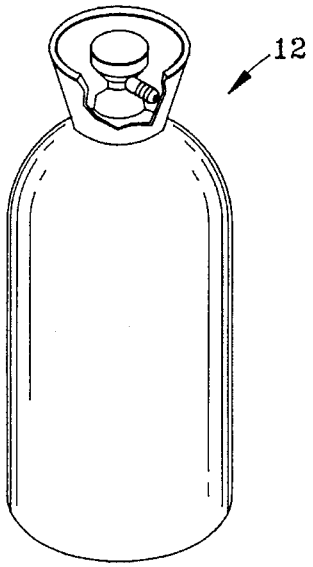
FIG. 2 is a perspective view of a standard carbon dioxide tank.

Reference is now made to FIG. 1 which shows the invention in its most basic form and is the preferred embodiment of tank holder 10 for the carbon dioxide tank 12 shown in FIG. 2. The tank holder 10 comprises two rings 20 and 22 with an inside diameter slightly larger than the outside diameter of carbon dioxide tank 12. Rings 20 and 22 are joined by legs 24, 26, and 28. As an option, legs 24, 26, and 28 have apertures 30, 32 and 34 in a foot portion of each of legs 24, 26 and 28. Such feet which allow for bolting to the truck or bar or restaurant floor. The type of aperture will depend on the fastening device used.

Figure 3:
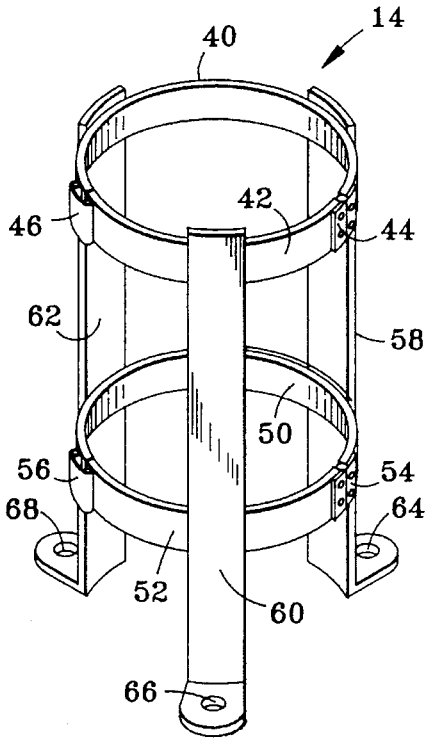
FIG. 3 illustrates another embodiment of the invention in a perspective view of the hinged embodiment when it is closed.

FIG. 3 shows another embodiment of the tank holder 14 in which the rings are hinged. This hinge and latch combination allows insertion and removal of carbon dioxide tanks from the front instead of only from the top. The rings are in two pieces, the ring stationary parts 40 and 50, and the hinged ring parts of 42 and 52. The two ring parts of 40 and 42 and of 50 and 52 are permanently joined by hinges 44 and 54, respectively. The rings are joined at the other end when closed by latches 46 and 56.

Figure 4:
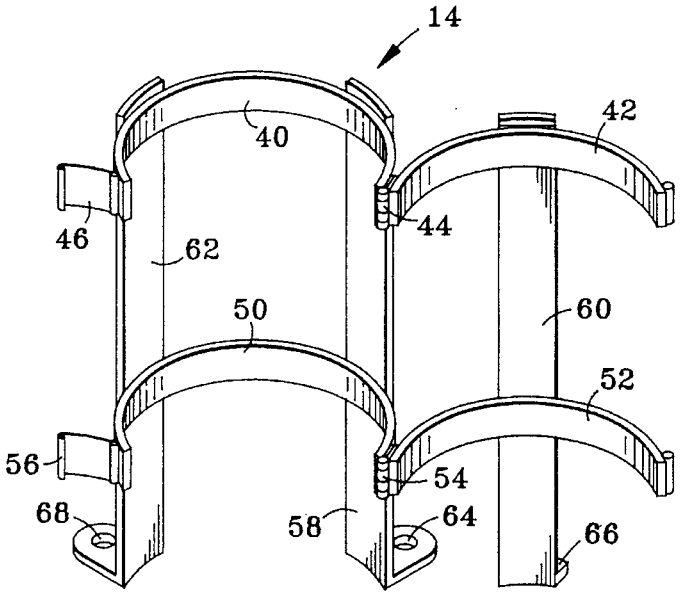
FIG. 4 is a perspective view of the hinged embodiment of the invention when it is open.

FIG. 4 shows embodiment of tank holder 14 in an open position with the same elements. The two ring pieces 40 and 42 of the top ring are joined by hinge 44 with latch 46 open. The two ring pieces 50 and 52 of the lower ring are joined by hinge 54 with latch 56 open. Both the top ring and lower ring are held together by legs 58, 60, and 62 each of the legs may preferably have a foot portion at the bottom end of each leg. Leg 60 moves with the movable part of tank holder 14 and need not have a foot portion.

The tank holder 10 can be assembled easily. The rings 20 and 22 can be attached to legs 24, 26, and 28 by welding, where metal is the material used, by gluing where appropriate plastic material is used, or using mechanical fasteners with any appropriate material. Welding would leave less material protruding to get caught on surfaces or materials. Mechanical fasteners would make repairs easier in case of breakage. Holes 30, 32, and 34 can be drilled before or after assembly of tank holder 10.

Tank holder 14 can be assembled almost as easy. Hinges 44 and 54 would be added to join ring sections 40 and 42 and sections 50 and 52. Latches 46 and 56 would secure the two hinged rings. Legs 58, 60, and 62 could then be attached by welding, gluing or mechanical fasteners.

The tank holders 10 and 14 are used in the transportation of carbon dioxide tanks by first securing them to the floor of the vehicle transporting the tanks. They are secured by appropriate fasteners through feet apertures 30, 32, and 34 for holder 10 and 64 and 68 of tank holder 14. (Securing leg 60 would prevent the opening of the hinged part.) Tanks of carbon dioxide are then loaded from the top or from the front depending on the embodiment in use. It is obvious that it may be desirable to add a fourth (4th) leg similar to legs 58 and 62 and having a foot portion and a hole in the foot portion. This fourth leg while it may be preferable is not essential and is thus not shown. The fourth leg would be positioned substantially between legs 58 and 62. Such a fourth leg, with a may be needed to provide additional support for the rack of the type illustrated by numeral 14 of FIGS. 3 and 4.

In a bar, restaurant, hospital or where ever such tanks are in use, the tank holders are used in much the same way. If there is enough room to insert the tanks from the top, embodiment of tank holder 10 is secured on the floor. Tank holder 10 feet which are flared may offer enough security that the tank will not be knocked over. For a more permanent arrangement, the tank holder 10 may be bolted or mechanically attached through holes 30, 32, and 34.

Tank holder 14 can be installed in places where top insertion of the carbon dioxide tanks is not feasible. Again, securing by mechanical attachments to the floor is optional. Leg 60 must be free to swing on the hinge while loading or unloading a tank, but may be secured in between times by means of aperture 66.

Tank holder 14 can also be used where a high rate of tank movement occurs. The filled tanks weigh between 37 and 43 pounds apiece. One tank is not that difficult to pick up and insert into a type tank holder 10. Picking up and moving 20 or 30 tanks a day is different. At that point, one would appreciate the ease that tank holder 14 offers of opening a gate, sliding or rolling a tank in, and closing and latching the gate.

There are many varieties possible of the tank holder. The size of the rings may change depending on the material used in manufacture and the strength of such material. The number of rings may vary. The inside diameter of the rings must remain close to the outside diameter of the tank that it secures, however. The number of legs may vary. The first prototype had four legs. The material and the shape of the material may vary. The stainless steel used for legs may be flat along the sides or have a partially flattened angle iron shape for added strength. The bottom of the feet may be flared or at a right angle. The bent material may angle out or be bent into the center. The choice of materials can vary as long as the resulting tank holder is both strong and relatively light weight.

Another feature would allow either embodiment to be attached to a wall. Any well known means to prevent the carbon dioxide tank from going completely through the tank holder could be employed. For example, blocks could be attached to the inner surface of either the leg or legs or to the inner surface of the lower most ring. The leg elements may or may not extend below the lower ring such as legs used in tank holder 10 or 14. This embodiment could make use of wall space that often goes to waste. A bank of carbon dioxide tanks could be placed on a wall and kept off of valuable floor space which could then be put to a more profitable use. Any well known means of attaching could be placed on either the rings or one or more of the legs.

The description so far assumes the tank holders are to be used in a vertical fashion. However, they could just as easily be horizontal and the tanks slipped in horizontally. It is even possible to transport or use the tanks at an angle. For example, a bank of carbon dioxide tanks might be used at a 45 degree angle. In such a case, the three legs would not be of the same length. The above descriptions and the claims do not limit use of the invention in any one plane. Clearly, the holders could be vertical or horizontal or any position in between. However, for ease of reference, the vertical position was described.

It is thought that many of the attendant advantages will be understood from the foregoing description and it will be apparent that various changes may be made in the form or geometry of the width of the rings and of the number of rings or legs, in the size, the construction, arrangement and materials used for the parts thereof without departing from the spirit and scope of the invention or sacrificing all of its material advantages, the form hereinbefore described being merely a preferred or exemplary embodiment thereof.

I claim:

1. A holder for securing and holding in a stable position a tank of the type which, when in use, contains a compressed gas such as carbon dioxide used for carbonating soft drinks, said holder comprising:

at least two circular rings each said circular ring having a substantially same width and a substantially same diameter said width of each said circular ring being less than each said diameter and said diameter being sufficient to permit said tank to be inserted within each said circular rings;

at least three leg members each leg member tangentially affixed to each said circular rings in such a manner as to be substantially perpendicular to a plane formed by each said circular ring and parallel to a centerline defined by a center of each said circular ring when all said leg members and all said circular rings are affixed;

means for attaching said holder to a frame means thereby preventing the movement of said holder when said tank is positioned therein and wherein each said circular ring is comprised of two pieces, a stationary part and a hinged part, said stationary part and said hinged part of each said circular ring joined together at a hingeable end by a hinge and at a lockable end by a lockable latch.

* * * * *